US006684928B2

(12) United States Patent
Dieckmann

(10) Patent No.: US 6,684,928 B2
(45) Date of Patent: Feb. 3, 2004

(54) AWNING, IN PARTICULAR SUN ROOM AWNING

(75) Inventor: Martin Dieckmann, Mettingen (DE)

(73) Assignee: Schmitz-Werke GmbH & Co. KG, Emsdetten (DE)

( * ) Notice: Subject to any disclaimer, the term of this patent is extended or adjusted under 35 U.S.C. 154(b) by 0 days.

(21) Appl. No.: 10/423,919

(22) Filed: Apr. 28, 2003

(65) Prior Publication Data

US 2003/0201073 A1 Oct. 30, 2003

(30) Foreign Application Priority Data

Apr. 26, 2002 (DE) ..... 102 18 572

(51) Int. Cl.[7] ..... E04F 10/06
(52) U.S. Cl. ..... 160/68; 160/310; 160/265
(58) Field of Search ..... 160/310, 265, 160/238, 322, 267.1, 268.1, 66, 68; 242/388

(56) References Cited

U.S. PATENT DOCUMENTS

| | | | | |
|---|---|---|---|---|
| 3,747,132 A | * | 7/1973 | Foster | 4/502 |
| 5,287,908 A | * | 2/1994 | Hoffmann et al. | 160/121.1 |
| 5,353,859 A | * | 10/1994 | Oltahfer et al. | 160/310 |
| 6,215,265 B1 | | 4/2001 | Wolfer et al. | |
| 2002/0002800 A1 | | 1/2002 | Schmitz | |
| 2003/0019588 A1 | * | 1/2003 | Schmitz | 160/66 |

FOREIGN PATENT DOCUMENTS

| | | |
|---|---|---|
| DE | 44 40 449 | 6/1995 |
| DE | 195 05 273 | 8/1997 |
| DE | 197 10 390 | 9/1998 |
| DE | 198 41 958 | 3/2000 |
| DE | 100 33 419 | 1/2002 |

* cited by examiner

*Primary Examiner*—Blair M. Johnson
(74) *Attorney, Agent, or Firm*—Browdy and Neimark

(57) ABSTRACT

In an awning, in particular a sun room awning, comprising a fabric-roll shaft for retracting and extending an awning fabric; wherein the inward end of the awning fabric is joined to the fabric-roll shaft and the outward end of the awning fabric to a drop-out bar, and the drop-out bar is run in lateral guide rails; wherein elastic pull straps act on the drop-out bar on the side opposite the awning fabric, the pull straps being deviated by a deflection pulley in the vicinity of the end of the guide rail, and reversed towards the fabric-roll shaft and wound on the fabric-roll shaft upon extension and unwinding of the awning fabric and exercising tensile stress on the drop-out bar and thus on the awning fabric; wherein unwinding the awning fabric and winding up the pull straps take place by an electric motor drive of the fabric-roll shaft, and switchgear is provided for switching off the drive of the fabric-roll shaft upon complete extension; it is provided that the switchgear acts on the drive of the fabric-roll shaft for the drive to be switched off only after maximum extension being exceeded and the awning fabric being wound up by a defined angular range in the original direction of extension.

7 Claims, 2 Drawing Sheets

AWNING, IN PARTICULAR SUN ROOM AWNING

BACKGROUND OF THE INVENTION

1. Field of the Invention

The invention relates to an awning, in particular a sun room awning, comprising a fabric-roll shaft for retracting and extending an awning fabric; wherein the inward end of the awning fabric is joined to the fabric-roll shaft and the outward end of the awning fabric to a drop-out bar, and the drop-out bar is run in lateral guide rails; wherein elastic pull straps act on the drop-out bar on the side opposite the awning fabric, the pull straps being deviated by a deflection pulley in the vicinity of the end of the guide rail, and reversed towards the fabric-roll shaft and wound on the fabric-roll shaft upon extension and unwinding of the awning fabric and exercising tensile stress on the drop-out bar and thus on the awning fabric; wherein unwinding the awning fabric and winding up the pull straps take place by an electric motor drive of the fabric-roll shaft, and switchgear is provided for switching off the drive of the fabric-roll shaft upon complete extension.

2. Background Art

An awning of the generic type is known from U.S. 2003/0019588 A1. The sun room awning there described comprises elastic pull straps for the awning fabric to be tautened even when partially extended. Complete extension of the awning fabric is conventionally detected by a touch sensitive switch or an optical switch, in dependence on which the electric drive is stopped.

SUMMARY OF THE INVENTION

It is an object of the invention, in an awning of the type under regard, to ensure reliable tautening of the awning fabric and optically attractive appearance, in particular upon complete extension, accompanied with the fundamental advantages offered by elastic pull straps.

According to the invention, this object is attained by the switchgear acting on the drive of the fabric-roll shaft in such a way that the drive is switched off only after maximum extension being exceeded and the awning fabric being wound up by a defined angular range in the original direction of extension.

Switchgear according to the invention can vary in design. For instance, it can be put into practice in the form of a torque limiter that is available in lots of electric motors; in the form of a force-displacement transmitter that is integrated in the electric motor; in the form of electronic measuring means by which to detect the relative phase position of current and voltage as a function of strain on the electric motor; or in the form of external switchgear.

According to the invention, the conventional limit stop is abandoned and the power of the electric drive is used for tautening the awning fabric; or switching off in dependence on displacement is effected only when maximum extension has been exceeded.

In particular, provision can be made for the motion of the awning fabric to be stopped in dependence on torque upon extension as well as retraction.

Primarily, the idea will be to use an electric motor. However it is conceivable, in particular in the case of window awnings, to provide manual actuation, with the torque sensor, as it were, being replaced by an operator sensing. For maintenance of the set degree of fabric tautening, a self-locking mechanism must be provided between the manual actuating system, in particular a crank, and the fabric-roll shaft.

The awning fabric is fixed by piping in a piping groove of the fabric-roll shaft in a manner known per se.

In keeping with another embodiment, a deflection pulley for each pull strap is provided in front of the fabric-roll shaft in such a way that the pull straps run along the guide rails.

An advantageous possibility of putting into practice the switch-off behaviour according to the invention resides in that the switchgear is released in dependence on the tensile stress on the pull straps and on the awning fabric, in particular by the switchgear comprising a torque transmitter that is disposed on the fabric-roll shaft.

The invention also relates to a method of extension control of the awning fabric of a sun room awning, which is characterized in that the awning fabric, upon maximum extension, is wound up in the original direction of extension until given and desired tautening is reached.

Details of the invention will become apparent from the ensuing description of an exemplary embodiment, taken in conjunction with the drawing.

DESCRIPTION OF THE PREFERRED EMBODIMENT

Figure 1:
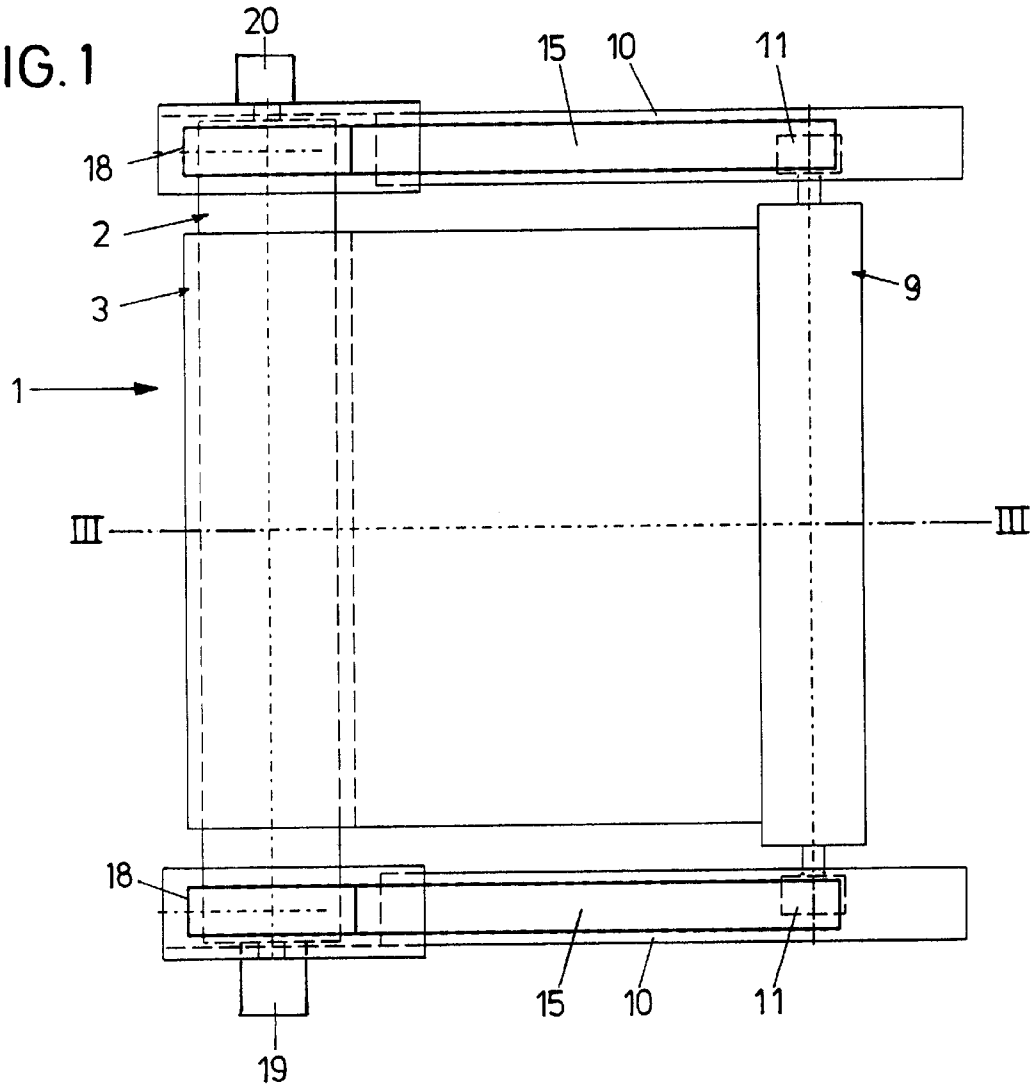
FIG. 1 is a plan view of a sun room awning according to the invention.
Figure 2:
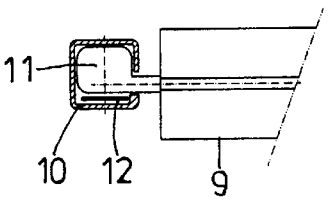
FIG. 2 is a section on the line II—II of FIG. 4.

A sun room awning 1 seen in FIG. 1 comprises a fabric-roll shaft 2, mounted for rotation on the wall of a house (not shown), for retraction and extension of an awning fabric 3, the inward end of which is fixed by a piping 4 in a piping groove 5 of the fabric-roll shaft 2, and the outward end of which is fixed by a piping 6 in the piping groove 7 of a drop-out bar 9. The drop-out bar 9 is run in lateral guide rails 10 by way of a respective slider 11 which slides on slide rails 12 of the guide rails 10.

The side of the drop-out bar 9 that faces away from the piping groove 7 is provided with another piping groove 14, with an elastic pull strap 15 being applied to both outer ends thereof; the pull strap 15 is deviated by a deflection pulley 16 on the drop-out side, reversed and again deviated by a deflection pulley 17 in the vicinity of the fabric-roll shaft 2 and wound on or off winding pulleys 18 on both sides of the fabric roll.

The fabric-roll shaft 2 is drivable, controlled by an electric motor 19, with a torque transmitter 20, which is mounted on the fabric-roll shaft 2, measuring the torque that acts on the fabric-roll shaft 2 in accordance with the tensile stress that acts on the awning fabric 3.

Figure 3:
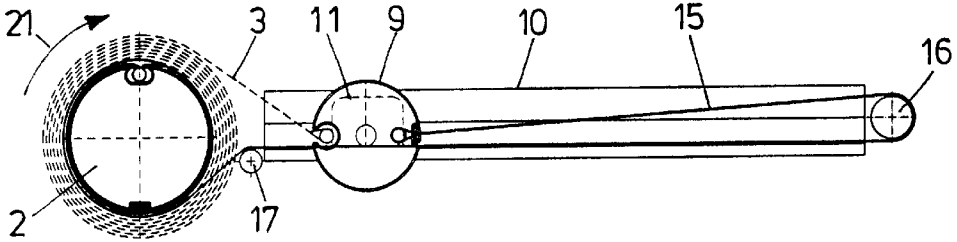
FIGS. 3 to 5 are sections on the line III—III of FIG. 1.
Figure 4:
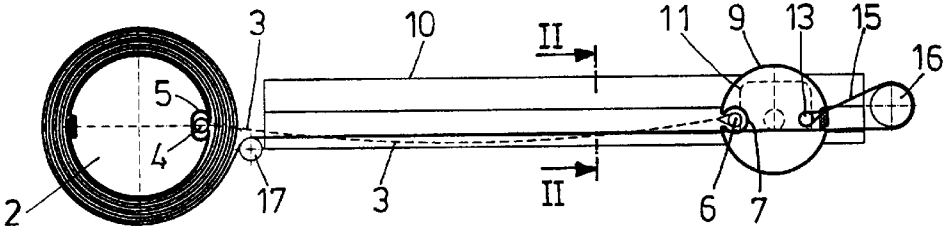
Figure 5:
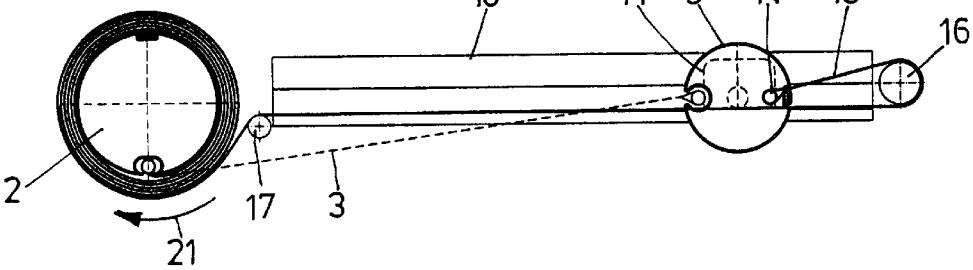

Proceeding from the retracted condition, seen in FIG. 3, of the awning fabric 3 and the drop-out bar 9, the fabric-roll shaft 2 is actuated by the electric motor 9 for extension of the awning fabric 3 in the direction of extension (arrow 21), with the condition of maximum extension, seen in FIG. 4, of the drop-out bar 9 then being reached. In this condition, the awning fabric 3 is extended radially away from the fabric-roll shaft 2 i.e., no fabric rests on the fabric-roll shaft 2 and the awning fabric 3 extends from the piping groove 5 directly radially outwards. As a result, when the fabric-roll shaft 2 continues to rotate by for example 90° in the original direction of extension (arrow 21), the awning fabric 3 is again wound on the fabric-roll shaft 2 by a corresponding length, and the drop-out bar 9 is retracted by some length, as seen in FIG. 5, as a result of which the elastic pull straps 15 are also wound up and tightened so that defined tensile stress acts on the awning fabric 3 in the extended condition, keeping it stretched.

The desired defined tensile stress is detected by a torque transmitter 20 which is disposed on the fabric-roll shaft 2 and the turning-moment of which is compared to a given desired value and which will then switch off the electric motor 19.

What is claimed is:

1. An awning, in particular a sun room awning, comprising a fabric-roll shaft (2) for retracting and extending an awning fabric (3);

wherein an inward end of the awning fabric (3) is joined to the fabric-roll shaft (2) and an outward end of the awning fabric (3) to a drop-out bar (9), and the drop-out bar (9) is run in lateral guide rails (10);

wherein elastic pull straps (15) act on the drop-out bar (9) on the side opposite the awning fabric (3), the pull straps (15) being deviated by a deflection pulley (16, 17) in the vicinity of the end of the guide rail (10) and reversed towards the fabric-roll shaft (2) and wound on the fabric-roll shaft (2) upon extension and unwinding of the awning fabric (3) and exercising tensile stress on the drop-out bar (9) and thus on the awning fabric (3);

wherein unwinding the awning fabric (3) and winding up the pull straps (15) take place by an electric motor drive (19) of the fabric-roll shaft (2), and switchgear is provided, switching off the drive (19) of the fabric-roll shaft (2) upon complete extension; and wherein the switchgear (20) acts on the drive (19) of the fabric-roll shaft (2) for the drive (19) to be switched off only after maximum extension being exceeded and the awning fabric (3) being again wound up by a defined angular range in the original direction of extension (21).

2. An awning according to claim 1, wherein the awning fabric (3), upon extension as well as retraction, is stopped in dependence on an achieved turning moment.

3. An awning according to claim 2, wherein the inward end of the awning fabric (3) is fixed by a piping (4) in a piping groove (5) of the fabric-roll shaft (2).

4. An awning according to claim 1, wherein a deflection pulley (16, 17) for the pull straps (15) is provided in front of the fabric-roll shaft (2) so that the pull straps (15) run along the guide rails (10).

5. An awning according to claim 1, wherein the switchgear is released in dependence on the tensile stress on the pull straps (15) and on the awning fabric (3).

6. An awning according to claim 5, wherein the switchgear includes a torque transmitter (20) that is mounted on the fabric-roll shaft (2).

7. A method of extension control of an awning fabric of an awning, in particular a sun room awning, comprising a fabric-roll shaft (2) for retracting and extending an awning fabric (3);

wherein an inward end of the awning fabric (3) is joined to the fabric-roll shaft (2) and an outward end of the awning fabric (3) to a drop-out bar (9), and the drop-out bar (9) is run in lateral guide rails (10);

wherein elastic pull straps (15) act on the drop-out bar (9) on the side opposite the awning fabric (3), the pull straps (15) being deviated by a deflection pulley (16, 17) in the vicinity of the end of the guide rail (10) and reversed towards the fabric-roll shaft (2) and wound on the fabric-roll shaft (2) upon extension and unwinding of the awning fabric (3) and exercising tensile stress on the drop-out bar (9) and thus on the awning fabric (3);

wherein unwinding the awning fabric (3) and winding up the pull straps (15) take place by an electric motor drive (19) of the fabric-roll shaft (2), and switchgear is provided, switching off the drive (19) of the fabric-roll shaft (2) upon complete extension;

wherein the switchgear (20) acts on the drive (19) of the fabric-roll shaft (2) for the drive (19) to be switched off only after maximum extension being exceeded and the awning fabric (3) being again wound up by a defined angular range in the original direction of extension (21); and wherein the awning fabric (3), upon maximum extension, is wound up in the original direction of extension until given desired tautening is reached.

* * * * *